US007021753B2

(12) United States Patent
Sano et al.

(10) Patent No.: US 7,021,753 B2
(45) Date of Patent: Apr. 4, 2006

(54) IMAGE HEATING DEVICE HAVING EXCESSIVE TEMPERATURE RISE PREVENTION FUNCTION

(75) Inventors: Tetsuya Sano, Shizuoka (JP); Hideo Nanataki, Kanagawa (JP); Takao Kume, Shizuoka (JP); Takashi Nomura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/243,666

(22) Filed: Sep. 16, 2002

(65) Prior Publication Data

US 2003/0058320 A1 Mar. 27, 2003

(30) Foreign Application Priority Data

Sep. 21, 2001 (JP) ..... 2001-289063

(51) Int. Cl.
*B41J 2/01* (2006.01)

(52) U.S. Cl. ..... 347/102; 399/320

(58) Field of Classification Search ..... 399/320, 399/328, 330; 347/102, 156, 103, 101
See application file for complete search history.

(56) References Cited

U.S. PATENT DOCUMENTS

| | | | | |
|---|---|---|---|---|
| 5,153,654 | A | 10/1992 | Yuminamochi et al. | 355/277 |
| 5,177,549 | A | 1/1993 | Ohtsuka et al. | 355/284 |
| 5,543,904 | A | 8/1996 | Kato et al. | 355/285 |
| 5,568,240 | A | 10/1996 | Ohtsuka | 355/285 |
| 5,666,627 | A * | 9/1997 | Yamaguchi | 399/330 |
| 5,778,293 | A * | 7/1998 | Ohtsuka | 399/329 |
| 5,819,149 | A * | 10/1998 | Watanabe et al. | 399/330 |
| 5,819,150 | A * | 10/1998 | Hayasaki et al. | 399/330 |
| 5,870,660 | A * | 2/1999 | Ito et al. | 399/330 |
| 5,881,349 | A | 3/1999 | Nanataki et al. | 399/328 |
| 5,940,655 | A | 8/1999 | Sano et al. | 399/69 |
| 5,970,299 | A | 10/1999 | Sano et al. | 399/330 |
| 6,014,539 | A * | 1/2000 | Sano et al. | 399/329 |
| 6,031,215 | A | 2/2000 | Nanataki et al. | 219/619 |
| 6,049,691 | A | 4/2000 | Abe et al. | 399/330 |
| 6,072,964 | A | 6/2000 | Abe et al. | 399/69 |
| 6,078,780 | A * | 6/2000 | Abe et al. | 399/328 |
| 6,246,035 | B1 * | 6/2001 | Okuda | 219/619 |
| 6,246,843 | B1 | 6/2001 | Nanataki et al. | 399/45 |
| 6,263,172 | B1 * | 7/2001 | Suzuki et al. | 399/67 |
| 6,343,195 | B1 | 1/2002 | Abe et al. | 399/69 |
| 6,347,201 | B1 | 2/2002 | Sano et al. | 399/67 |
| 6,347,211 | B1 | 2/2002 | Nanataki et al. | 399/288 |
| 2002/0051663 | A1 * | 5/2002 | Kinouchi et al. | 399/330 |

FOREIGN PATENT DOCUMENTS

| | | |
|---|---|---|
| JP | 7-114276 | 5/1995 |
| JP | 10-39676 | 2/1998 |
| JP | 11-143272 | 5/1999 |

* cited by examiner

*Primary Examiner*—Manish Shah
*Assistant Examiner*—Leonard Liang
(74) *Attorney, Agent, or Firm*—Fitzpatrick, Cella, Harper & Scinto

(57) ABSTRACT

An image heating device for heating an image formed on a recording material is provided which has a heating member; an excitation coil for generating a magnetic field to induce an eddy current in the heating member; a temperature detecting member for detecting a temperature of the heating member, the temperature detecting member being arranged at a position in opposition to a heat generation area of the heating member; and an insulating holder that holds the temperature detecting member.

7 Claims, 9 Drawing Sheets

IMAGE HEATING DEVICE HAVING EXCESSIVE TEMPERATURE RISE PREVENTION FUNCTION

BACKGROUND OF THE INVENTION

1. Field of the Invention

The present invention relates to an image heating device, which is suitable for mounting in an image forming apparatus such as a copying machine or a printer using a recording technique of an electrophotographic or an electrostatic recording system, and, more particularly, to an image heating device having a function of shutting off heat generation in case where temperature excessively rises.

2. Related Background Art

Heretofore, as an image heating device represented by a heat-fixing device, there has been widely used a fixing device of a thermal roller type.

The thermal roller type fixing device has a press-contacting roller pair consisting of a fixing roller (heating roller) and a pressure roller as the fundamental structure, and the pair of rollers are rotated to allow a recording material having an unfixed image formed thereon to be introduced to a fixing (heating) nip portion, which is a mutually press-contacting portion of the pair of rollers, so as to be sandwiched and conveyed, so that the unfixed image is thermally pressure-fixed on the recording material by the heat of the fixing roller and the pressure force of the fixing nip portion.

The fixing roller generally has a hollow metal roller of aluminum as a substrate (core bar), and in the internal space thereof is provided a halogen lamp as a heat source, and the energization to the halogen lamp is controlled so as to heat the fixing roller by heat generation of the halogen lamp and maintain an outer periphery thereof at a predetermined fixing temperature, so that the temperature is adjusted.

On the other hand, in Japanese Patent Application Laid-Open No. 7-114276 and Japanese Patent Application Laid-Open No. 11-143272 is disclosed an induction heat-fixing device, which induces an electric current in a fixing film by a magnetic flux and a heat is generated therein by the joule heat. This makes it possible to allow a rotating member for fixation such as a fixing film and a fixing roller to directly generate a heat by using generation of an induction current, and makes it possible to achieve a fixing process of a much higher efficiency.

Incidentally, the above-described fixing device has usually a safety device or the like with a temperature detecting member such as a thermoswitch or the like.

This is, for example, to prevent an excessive temperature rise during stopping of rotation due to breakage of a rotational driving gear or run away driving due to malfunction of temperature control, and to detect the excessive temperature rise so as to stop heating operation of the device and secure the safety of the device.

Further, as an arrangement method of the temperature detecting member as the safety device, a method of such a constitution is employed, in which the temperature detecting member is held so as not to be in contact with the outer peripheral surface of the fixing roller or the film in order to prevent contact traces of the temperature detecting member from generating on the surface of the rotating member for fixation to develop image defects.

However, particularly in the fixing device employing a flexible rotating member for fixation (fixing film), depending on a supporting method of the temperature detecting member, there was the case where the following malfunction occurred. That is, with regard to the fixing device of a film type, since the heat conduction by the film itself is not high, such a constitution is desirable, wherein the arrangement position of the temperature detecting member is as close as possible to a heat generation area, that is, an area in which an eddy current is generated. However, for example, in the case where the constitution is such that the support member of the temperature detecting member is arranged in the heat generation area in the longitudinal direction of the fixing device so that the temperature detecting member is positioned close to the heat generation area, depending on the material of the support member and the input electric power, the support member may be affected by a leaked magnetic flux in the vicinity of the heat generation area to generate a heat by itself to effect temperature rise, and the distance between the temperature detecting member and the film is varied by thermal expansion, and at the worst, there has been the case where the temperature detecting member and the film were brought into contact with each other. In such a case, it is considered that the temperature detection may be not properly performed as a safety device, and heating operation may be stopped even within the permissible temperature range, and the contact traces may be developed on the image by flaws generated by contact between the temperature detecting member and the outer peripheral surface of the film.

Although it is certainly possible to set a large distance between the temperature detecting member and the outer peripheral surface of the film, if the distance is too large, malfunctions may occur such as the temperature detection being not correctly performed as the safety device and the like even during excessive temperature rise, and there has been a limit imposed on the distance.

The problems such as described above tend to occur more frequently in the fixing device having a flexible rotating member for fixation (fixing film) than in the fixing device having a rigid rotating member for fixation (fixing roller) because the magnetic flux which leaks outside of the rotating member is greater in the former than in the latter.

SUMMARY OF THE INVENTION

The present invention has been made in view of the above-described problems and it is, therefore, an object of the present invention to provide an image heating device capable of correctly detecting the temperature of a heating member.

Further, it is another object of the present invention to provide an image heating device in which a safety device correctly operates.

Moreover, it is still another object of the present invention to provide an image heating device having a safety device that is hard to be affected even when a leaked magnetic flux exists.

According to the present invention, there is provided an image heating device for heating an image formed on a recording material, comprising a heating member; an excitation coil for generating a magnetic field to induce an eddy current in the heating member; a temperature detecting member for detecting a temperature of the heating member, the temperature detecting member being arranged at a position in opposition to a heat generation area of the heating member; and an insulating holder that holds the temperature detecting member.

Still another object of the present invention will be clear by reading the following detailed description with reference to the attached drawings.

DESCRIPTION OF THE PREFERRED EMBODIMENTS

First Embodiment

Figure 12:
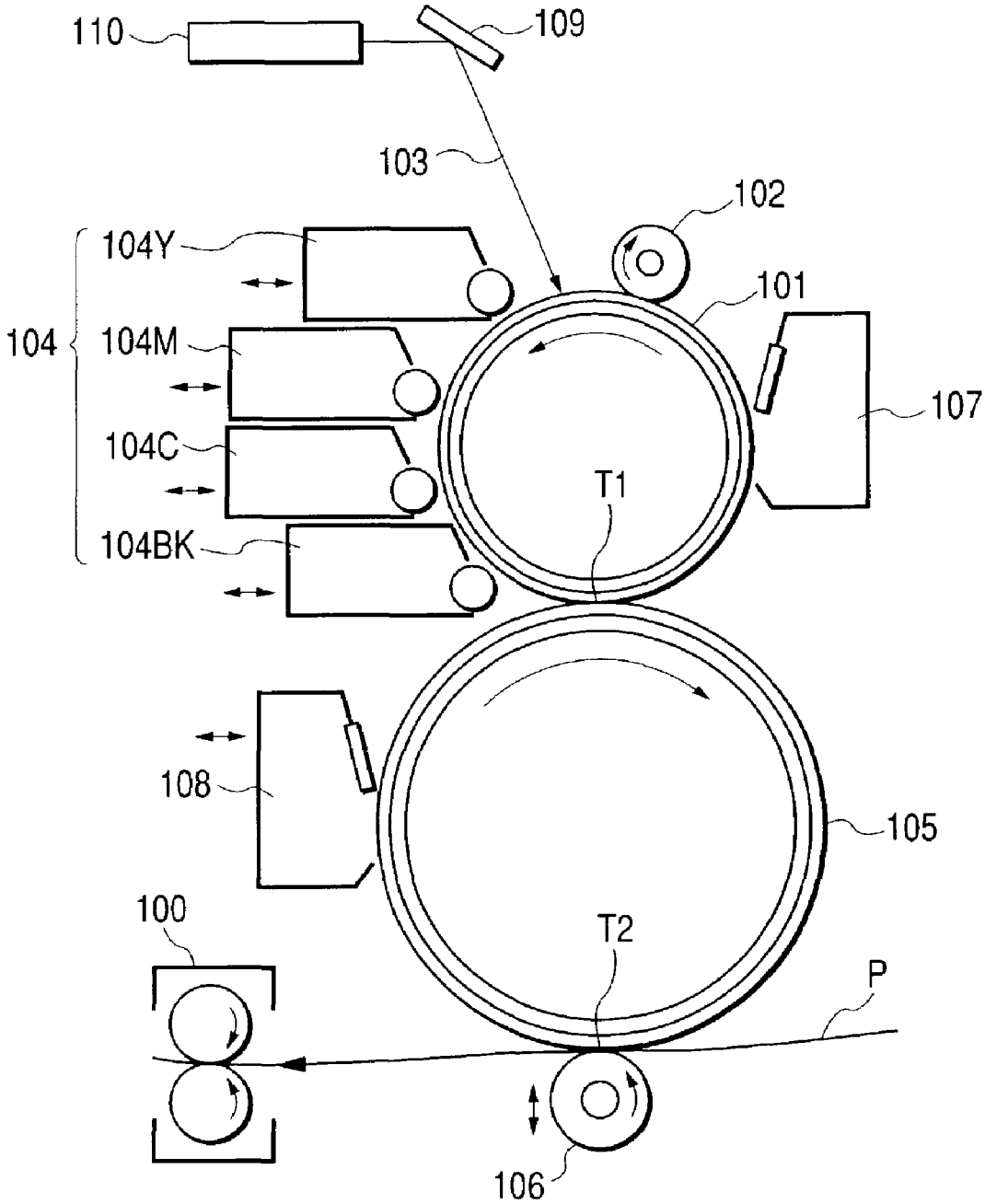
FIG. 12 is a schematic constitutional view of an image forming apparatus used in the first embodiment.

FIG. 12 is a sectional view of an image forming apparatus in the case where an image heating device of an embodiment of the present invention is used as a fixing device of a color image forming apparatus.

First, the operation of the apparatus will be described as follows.

Reference numeral 101 denotes an electrophotographic photosensitive drum (image bearing member) made of an organic photosensitive member, an amorphous silicon photosensitive member or the like, and is rotationally driven counterclockwise in the direction shown by the arrow at a predetermined process speed (circumferential speed).

The photosensitive member drum 101 is subjected to a charging process of a predetermined uniform polarity and electric potential by a charging device 102 such as a charging roller and the like during the rotation thereof.

Subsequently, the photosensitive member drum 101 is subjected to a scanning exposure process with the objective image information on its charged surface by a laser beam 103 outputted from a laser optical box (laser scanner) 110. The laser optical box 110 outputs the laser beam 103 modulated (on/off) corresponding to time series electric digital pixel signals of the objective image information from an image signal generator such as an image reading device not shown and the like, and scan-exposes the rotational photosensitive member drum surface. By this scanning exposure, an electrostatic latent image corresponding to the objective image information, which was scan-exposed on the surface of the rotational photosensitive member drum 101, is formed. Reference numeral 109 denotes a mirror, which allows the laser beam outputted from the laser optical box 110 to be polarized toward an exposure position of the photosensitive member drum 101.

In the case of a full color image formation, the scanning-exposure and latent image formation on a first color separation component image of the objective full color image, for example, a yellow component image is performed, and the latent image thereof is developed as a yellow toner image by operation of a yellow developing device 104Y of four color developing devices 104. The yellow toner image is transferred on the surface of an intermediate transferring drum 105 at a primary transferring portion T1 which is a contact portion (or adjacent portion) between the photosensitive member drum 101 and the intermediate transferring member drum 105. The surface of the rotational photosensitive member drum 101 after the toner image transfer onto the surface of the intermediate transferring drum 105 is subjected to elimination by a cleaner 107 of adhering residual matters such as an after-transfer remaining toner to be cleaned.

The process cycle of the charging, scanning-exposure, developing, primary transfer, and cleaning as described above is carried out successively with regard to each color separation component image of a second color separation component image (for example, a magenta component image, in which case a magenta developing device 104M operates), a third color separation component image (for example, a cyan component image, in which case a cyan developing device 104C operates) and a fourth color separation component image (for example, a black component image, in which case a black developing device 104BK operates) of the objective full color image, and on the surface of the intermediate transferring member drum 105 are superposed and transferred successively a total of four color toner images of a yellow toner image, a magenta toner image, a cyan toner image and a black toner image, so that a color toner image corresponding to the objective full color image is synthesized and formed.

The intermediate transferring member drum 105 has a medium resistance elastic layer and a high resistance surface layer on a metallic drum, and contacts or is adjacent to the photosensitive member drum 101, and is rotationally driven in the by arrow marked clockwise direction at almost the same circumferential speed as that of the photosensitive member drum 101. A bias electric potential is given to the metallic drum of the intermediate transferring member drum 105 and, by utilizing the difference between that potential and the potential of the photosensitive member drum 101, the toner image on the surface of the photosensitive member drum 101 is transferred on the surface of the intermediate transferring member drum 105.

The color toner image synthesized and formed on the surface of the intermediate transferring member 105 is transferred on the surface of a recording material P fed at a predetermined timing from a paper feeding portion (not shown) at a secondary transferring portion T2 which is a contact nip portion between the rotational intermediate transferring member drum 105 and the transferring roller 106. The transferring roller 106 collectively transfers the synthesized color toner images to the recording material P from the surface of the intermediate transferring member drum 105 by providing a charge of a polarity opposite to the polarity of the toner to the back surface of the recording material P.

The recording material P which has passed through the secondary transferring portion T2 is separated from the surface of the intermediate transferring member drum 105 and is introduced to an image heating device (fixing device) 100 and, after having been subjected to heat fixing of an unfixed toner image, is discharged to a discharge tray outside of the apparatus (not shown) as a color image formed matter. As for the fixing device, the description thereof will be made in detail later.

The surface of the rotational intermediate transferring member drum 105 after the color toner image transfer onto the recording material P is subjected to elimination of the adhering residual matters such as the after-transfer remaining toner, paper dusts, or the like to be cleaned by the cleaner 108. This cleaner 108 is normally kept in non-contact with the intermediate transferring member drum 105, and is brought into and kept in contact with the intermediate transferring member drum 105 when carrying out the secondary transfer of the color image on the recording material P from the intermediate transferring member drum 105.

Further, the transferring roller 106 is also normally kept in non-contact with the intermediate transferring member drum 105, and is kept in contact with the intermediate transferring member drum 105 via the recording material P during the secondary transfer of the color toner image on the recording material P from the intermediate transferring member drum 105.

The image forming apparatus of the present embodiment can also execute a print mode of a monochromatic image such as a black and white image, and further can execute a duplex image print mode or a multiplex image print mode.

In the case of the duplex image print mode, the recording material P, which was outputted from the fixing device 100 and in which a first surface side print was made, is reversed turned over via a recycle conveying mechanism (not shown), and is again fed to the secondary transferring portion T2 and receives a toner image transfer on a second surface side, and is again introduced to the fixing device 100 to be subjected to fixing of the toner image on the second surface side, thereby outputting a duplex image print.

In the case of the multiplex image print mode, the recording material P, which was outputted from the fixing device 100 and in which a first time image print was made, is not turned over via the recycle conveying mechanism (not shown), and is again fed to the secondary transferring portion T2 and receives a second time toner image transfer on the surface in which the first time image print was made, and is again introduced to the fixing device 100 to be subjected to fixing f the second time toner image, thereby outputting the multiplex image print.

Next, the fixing device will be described.

Figure 1:
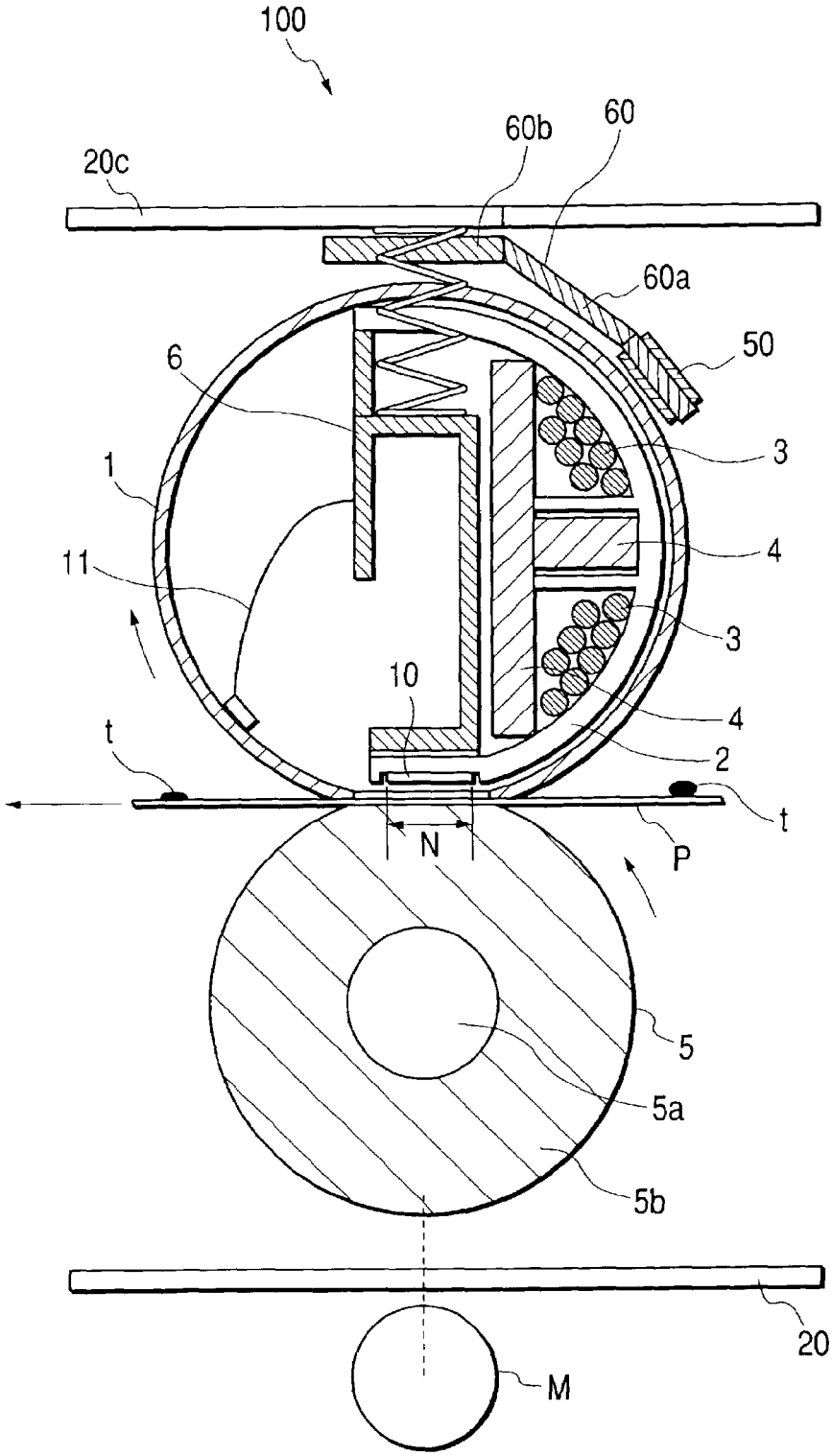
FIG. 1 is a sectional view of a heating device of a first embodiment.
Figure 2:
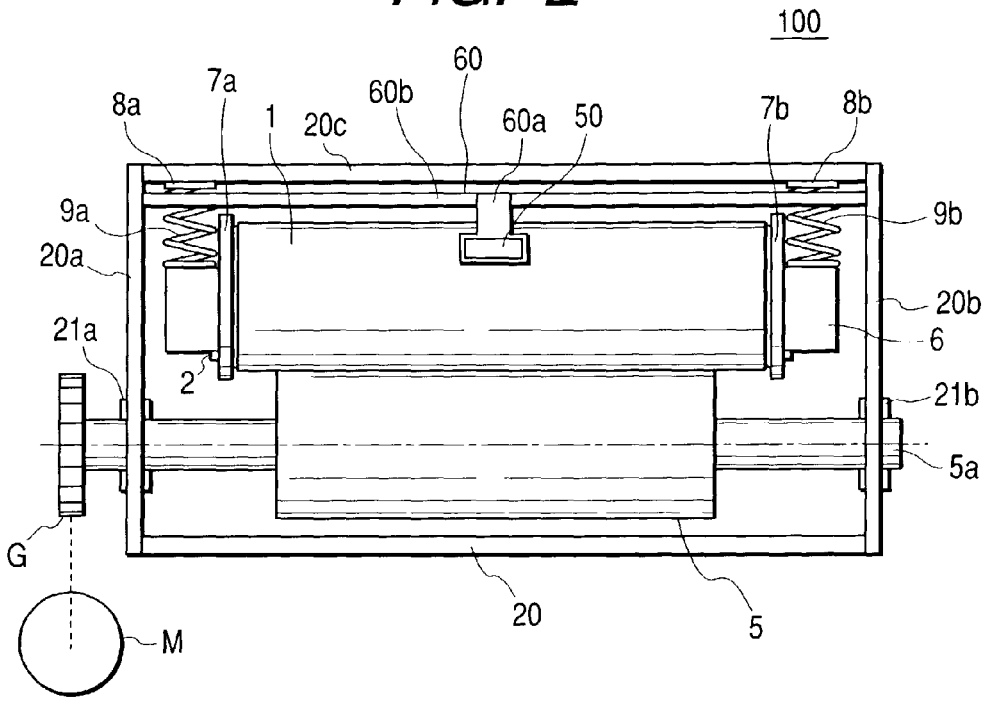
FIG. 2 is a schematic front view of the heating device of the first embodiment.
Figure 3:
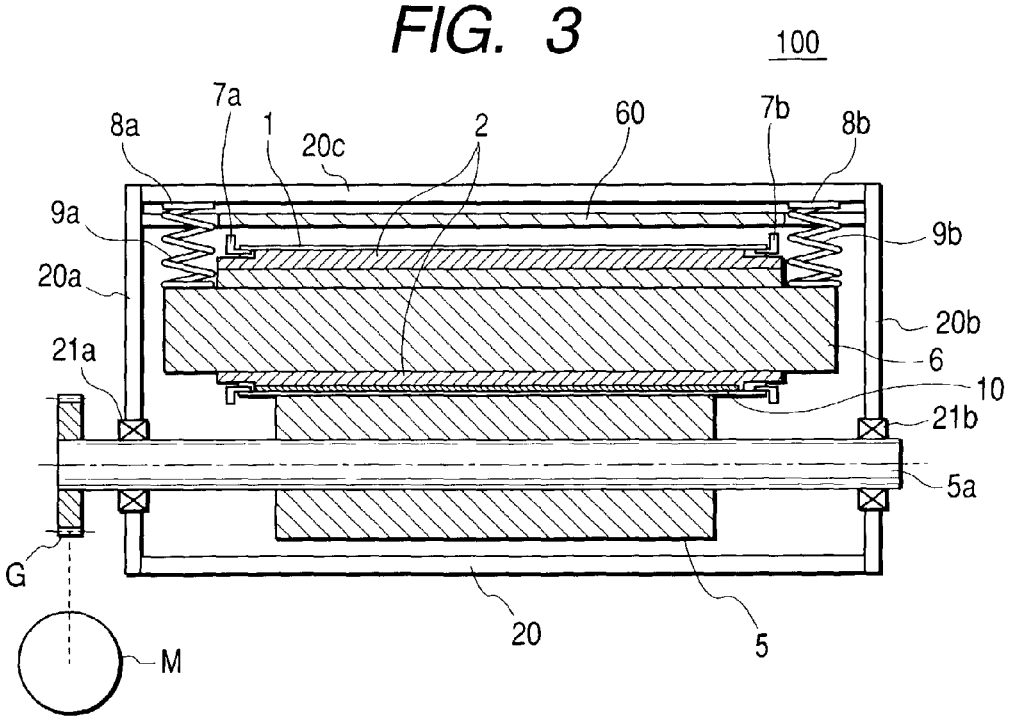
FIG. 3 is a longitudinal sectional view of the heating device of the first embodiment.
Figure 4:
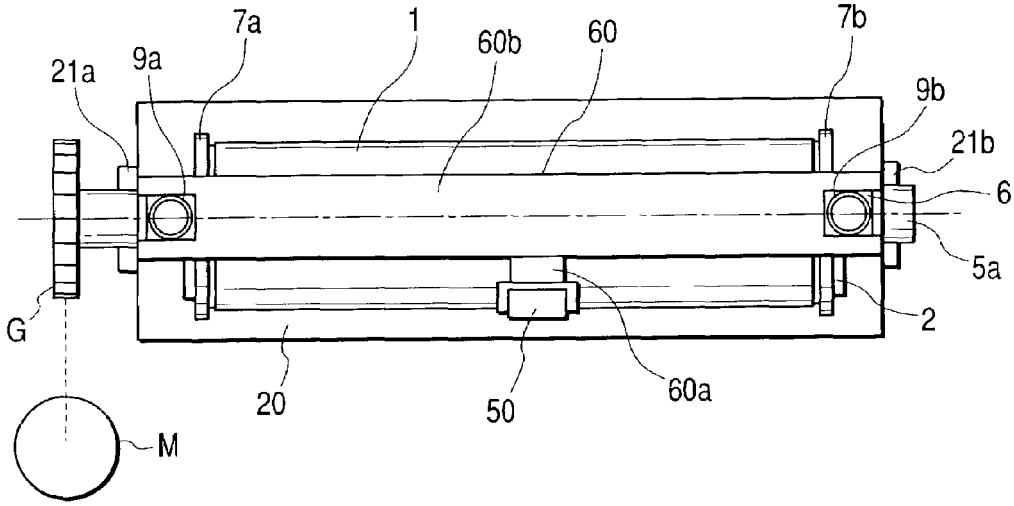
FIG. 4 is a schematic plan view of the heating device of the first embodiment.

FIG. 1 is a schematic vertical sectional view taken in the width direction of a body of the fixing device 100 of the present embodiment; FIG. 2 is a schematic front view of the body; FIG. 3 is a schematic vertical sectional view taken in the longitudinal direction (i.e., the direction perpendicular to the direction in which FIG. 1 is taken)of the body; and FIG. 4 is a schematic plan view of the body.

The present device 100 is an device of a pressure roller driving system and an electromagnetic induction heating system, using a cylindrical electromagnetic induction heat generation film.

Figure 5:
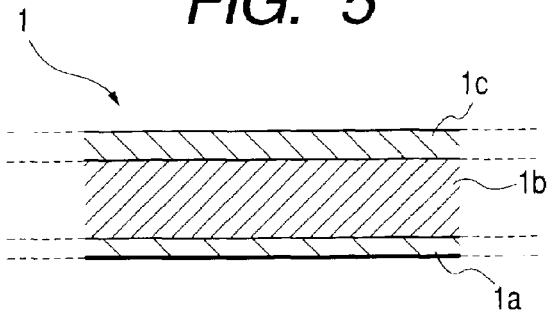
FIG. 5 is a schematic view illustrating a layer constitution of a fixing film.

As shown in FIG. 5, an endless, fixing film 1 as a rotating member is of a three-layer composite structure of a heat generation layer 1*a* made of a metal film or the like as a basic layer of the electromagnetic induction heat generation fixing film, an elastic layer 1*b* stacked on the outer surface thereof and a releasing layer 1*c* further stacked on the outer surface thereof. The heat generation layer 1*a* is preferably made of a metal of a ferromagnetic substance such as nickel, iron, ferromagnetic stainless steel, a nickel-cobalt alloy, or the like, and preferably has a thickness of 1–100 μm in the light of the balance between absorption efficiency of electromagnetic energy and rigidity of the film. The elastic layer 1*b* is a layer necessary to prevent generation of irregularity in brightness of the image by allowing a heating surface (releasing layer 1*c*) to follow the surface unevenness of the recording material or the surface unevenness of the toner layer when a color image or the like is to be fixed, and is preferably made of a material having good heat resistance and heat conductivity such as silicone rubber, fluororubber, fluorosilicone rubber and the like, and desirably has a thickness of 10–500 μm and a hardness of 60° (JIS-A) or less. The releasing layer 1*c* is preferably made of a material having good releasing properties and heat resistance such as fluororesin (PFA, PTFE, FEP), silicone resin, fluorosilicone rubber, fluororubber, silicone rubber or the like and preferably has a thickness of 1–100 μm. Further, although not shown in the figure, there may further be provided on the inner side of the heat generation layer 1*a* a heat insulation layer comprising a heat resistance resin such as fluororesin (PFA resin, PTFE resin, FEP resin), polyimide resin, polyamide resin, PEEK resin, PES resin, PPS resin and the like, so that the efficiency of heat supply to the recording material P is further enhanced. Incidentally, in FIG. 5, the upper surface of the fixing film 1 is defined as a pressure roller contact surface and the lower surface thereof is defined as a film guide surface.

A film guide member 2 is preferably made of a material having good electrical insulation properties and heat resistance such as phenol resin, polyimide resin, polyamide resin, polyamideimide resin, PEEK resin, PES resin, PPS resin, PFA resin, PTFE resin, FEP resin, LCP resin, or the like in order to secure electrical insulation between an excitation coil 3 and the film 1, and plays a role for applying a pressure to a pressure contact portion (nip portion N), supporting the excitation coil 3 and a magnetic core 4 as magnetic field generating means, supporting the fixing film 1 and securing conveyance stability during the rotation of the film 1.

A sliding member 10 provided between the film 1 of the nip portion N and the film guide 2 is for improving sliding properties between the film 1 and the film guide 2, and is preferably made of a material which is excellent in heat resistance and good in sliding properties with the film such as PI, glass-coated alumina or the like. Further, in order to improve the sliding properties much more, in addition to provision of the sliding member 10, a lubricant such as grease or the like is coated on the inner surface of the film 1.

The excitation coil 3 is a coil formed by bundling a plurality of insulation-coated, copper thin wires and wounding the bundle of wires several times and is connected to an excitation circuit. In the present embodiment, polyimide is used as a heat-resistant insulation coat, whose number of turns is eight (eight turns), and the coil is formed and provided along the film guide 2 so that heating in a large area is made possible. Further, the diameter of the thin wires, the sectional area of the bundled wire and the like are determined by the amount of electric current which flows in the excitation coil 3 and, in the present embodiment, 98 pieces of thin wires having a diameter of 0.2 mm are bundled (bundled wire sectional area: about 3.1 $mm^2$) to be used.

The magnetic core 4 is a core of a high magnetic permeability having a T-like sectional shape, and is preferably made of a material which is used in the core of a transformer such as ferrite (preferably a ferrite having little loss even at 100 kHz or more), permalloy, or the like.

The temperature detecting member 11 for controlling the energization of the coil 3 is to detect the temperature of the film 1, and more specifically, a temperature sensor such as a thermistor or the like is provided at a downstream side in the rotational direction behind the fixing nip on the inner surface of the film 1 as shown in the figure, and is used for temperature control for controlling the fixing film temperature to a predetermined temperature during the fixing operation.

The pressure roller 5 as a pressure member is constituted of a core bar 5*a* and a heat-resistant, elastic layer 5*b* such as of silicone rubber, fluororubber, fluororesin or the like, which is formed around the core bar so as to cover it, and the both end portions of the core bar 5*a* are rotatably held by bearings 21*a* and 21*b* and provided between side plates 20*a* and 20*b* of a chassis 20 of the device.

Flange members 7*a* and 7*b* are outwardly fitted to the both end portions in the longitudinal direction of the film guide member 2, and fix the longitudinal position while rotatably mounting the film guide member, and receive the both end portions of the film during the rotational of the fixing film 1 so as to play a role of suppressing the movement of the film in the direction of the width thereof.

On the upper side of the pressure roller 5 are provided a heating means unit comprising the film 1, the film guide 2, the excitation coils 3, the exciting core 4, a rigid stay 6 for pressuring and the flange members 7*a* and 7*b*, and pressure springs 9*a* and 9*b* are shrinkably provided between both end portions of the rigid stay 6 for pressuring and spring bearing members 8*a* and 8*b* of the device chassis side, so that a pushing down force acts on the rigid stay 6 for pressuring. In this way, the under surface of the film guide 2 and the upper surface of the pressure roller 5 are pressed against each other while sandwiching the fixing film 1 and the sliding member 10, thereby forming the fixing nip portion N having a predetermined width.

Reference character G denotes a driving gear fixed to an end portion of the core bar 5*a*, which is connected with a motor M as driving means via a drive transmission system (not shown). The pressure roller 5 is rotationally driven in the arrow-marked counterclockwise direction of FIG. 1 by a driving force of the motor M, which is transmitted to the driving gear G.

By this rotation, a rotational force acts on the fixing film 1 by a frictional force between the film 1 and the pressure roller 5 at the nip portion N, and accompanied with the driving of the pressure roller, the film is rotationally driven (pressure roller driving system).

The heating principle of the film will be described below.

Figure 6:
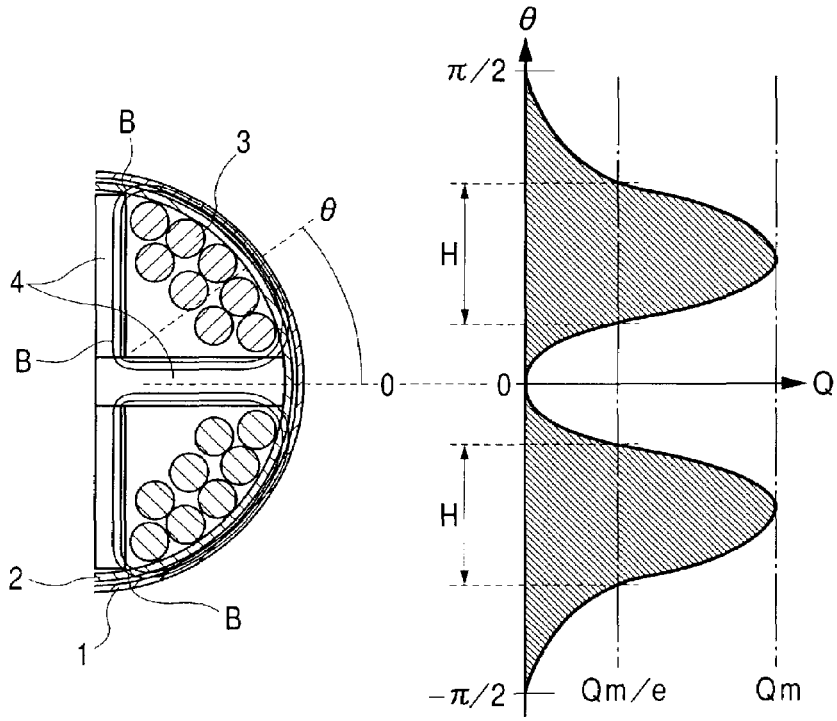
FIG. 6 is a view showing a state of magnetic flux generation and a state of heat generation of the heating device of the first embodiment.

An alternating current of 20 kHz to 500 kHz is flown from the excitation circuit to the excitation coil 3, so that an alternating magnetic flux is generated. FIG. 6 schematically shows the state of generation of the alternating magnetic flux, and the magnetic flux B represents a part of the generated magnetic flux.

In the case where magnetic field generating means is constituted and arranged as in the present embodiment, the alternating magnetic flux is formed in the core and the film as shown in FIG. 6. The alternating magnetic flux generates an eddy current in the heat generation layer 1*a* of the fixing film 1, and the eddy current generates a joule heat by the specific resistance of the heat generation layer 1*a*.

By the rotation of the film, the temperature of the entire film 1 rises, and the recording material P sandwiched and conveyed to the nip N and the toner t on the recording material P are heated via the elastic layer 1*b* and the releasing layer 1*c*.

Incidentally, the amount Q of heat generation is determined by the density of the magnetic flux which passes through the heat generation layer 1*a*, and can be calculated by power supply frequency, coil current, core material, sleeve thickness, positional relationship thereof, or the like, and is as shown in FIG. 6. In the graphical representation of FIG. 6, the ordinate shows a position in the circumferential direction in the fixing film 1 represented by an angle θ with the center of the magnetic core 4 being defined as 0, and the abscissas shows the amount Q of heat generation at the heat generation layer 1*a* of the fixing film 1. Here, the heat generation area H is defined as the area in which the amount of heat generation is not less than Qm/e when the maximum amount of heat generation is defined as Qm.

The temperature detecting member 50 such as a thermoswitch or the like as a safety device is fixed to the support member 60, and is arranged in a non-contact manner close to a position in opposition to the heat generation area H of the film 1 such that the distance from the outer peripheral surface of the film is 2 mm.

The support member 60 is constituted of an insulating holder portion 60*a* and a plate member portion 60*b* as a second holder. The holder portion 60*a* is preferably made of a material having good electrically insulating properties and heat resistance such as phenol resin, polyimide resin, polyamide resin, polyamideimide resin, PEEK resin, PES resin, PPS resin, PFA resin, PTFE resin, FEP resin, LCP resin, or the like, and fixes the temperature detecting member 50, and is provided at a portion in opposition to the heat generation area H. The plate member portion 60*b* is a plate-like member such as of a metallic material or the like, which can provide accuracy of position with relative ease and the end portions thereof are fixed to the chassis side plates 20*a* and 20*b* of the fixing device, and is provided above the film 1 outside the heat generation area H, in the longitudinal direction of the fixing device, and supports the holder portion 60*a* at a longitudinal center portion.

Next, the safety device of the fixing device will be described below.

In the present embodiment, in order to shut off energization (power supply) to the excitation coil 3 at the time of run away driving (overdriving), the safety device is provided.

Figure 7:
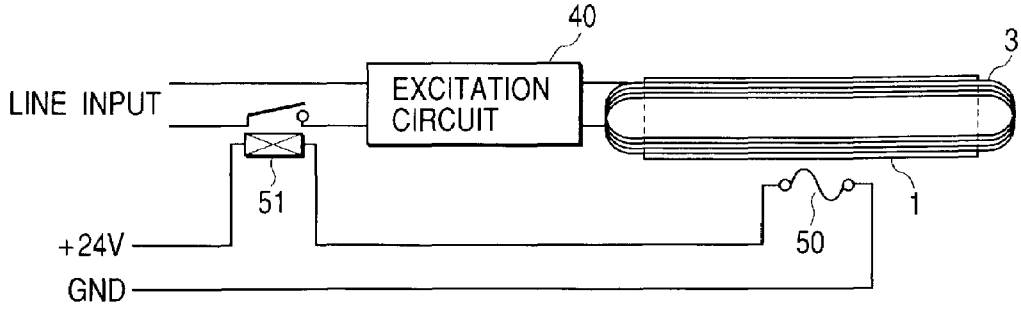
FIG. 7 is a view showing a safety circuit of the heating device of the first embodiment.

FIG. 7 shows a safety circuit used in the first embodiment, the constitution of which is such that the thermoswitch 50 as a temperature detection element is connected to a +24 V DC power source and a relay switch 51 in series, and when the thermoswitch 50 is turned off, power supply to the relay switch 51 is shut off, and the relay switch 51 operates to shut off power supply to the excitation circuit 40, thereby shutting off power supply to the excitation coil 3. The thermoswitch 50 is set to 220° C. for OFF operation temperature.

According to the first embodiment, even in the case where in the run away driving state of the fixing device due to device failure, the fixing device stops with the recording material being sandwiched, for example, at the fixing nip portion N, and power continues to be supplied to the excitation coil 3, and the fixing film 1 continues to generate heat, because the amount of heat generation is small at the nip portion N where a recording material is sandwiched, the recording material is hardly heated.

Further, because the thermoswitch 50 is provided in the heat generation area H that generates a large amount of heat, when the thermoswitch 50 senses 220° C. to be turned off, power supply to the excitation coil 3 is shut off by the relay switch 51. According to the first embodiment, since the ignition temperature of the recording material is about 400° C., heat generation of the fixing film can be prevented without firing of the recording material.

On the other hand, as for the support member 60, since the insulating holder portion 60*a* is arranged at a portion facing the heat generation area H, and the plate member portion 60*b* is arranged on a portion outside the heat generation area H, self-heat generation of the support member itself due to the leaked magnetic flux can be prevented, and thermal expansion of the support member can be suppressed. As a result, fluctuation of the distance between the temperature detecting member 50 and the outer peripheral surface of the film 1 by deflection or the like of the support member and frame member due to thermal expansion can be made small. This can prevent generation of, for example, such a problem that the distance between the temperature detecting member 50 and the outer peripheral surface of the film 1 becomes too small so that contact traces develop on the film surface or such a malfunction that the thermoswitch operates by slight overshooting during control of the temperature of the film to a predetermined temperature.

When a sheet paper passage test and a run away driving test were conducted by using the fixing device 100 of the present embodiment, the fixing device 100 normally operated in both of the sheet paper passage test and the run away driving test.

On the other hand, as a comparative example, when the sheet paper passage test and the run away driving test were similarly conducted by using a modified fixing device in which a portion facing the heat generation area H of the holder of the temperature detecting member is made of a metal, there were often the cases where fluctuation of the distance between the film and the temperature detecting member was caused by deflection due to thermal expansion of the support member in the sheet paper passage test; the safety device acted even in the normal operation state of the fixing device by overshooting during the temperature control; or contact traces developed on the image by contact between the temperature detecting member and the film.

Further, in the case where the temperature detecting member is arranged outside the heat generation area H, there were sometimes caused the disadvantages that the operation of the safety device was delayed at the time of run away driving.

Incidentally, as a temperature detection element other than a thermoswitch, a temperature fuse may be included.

Second Embodiment

Figure 8:
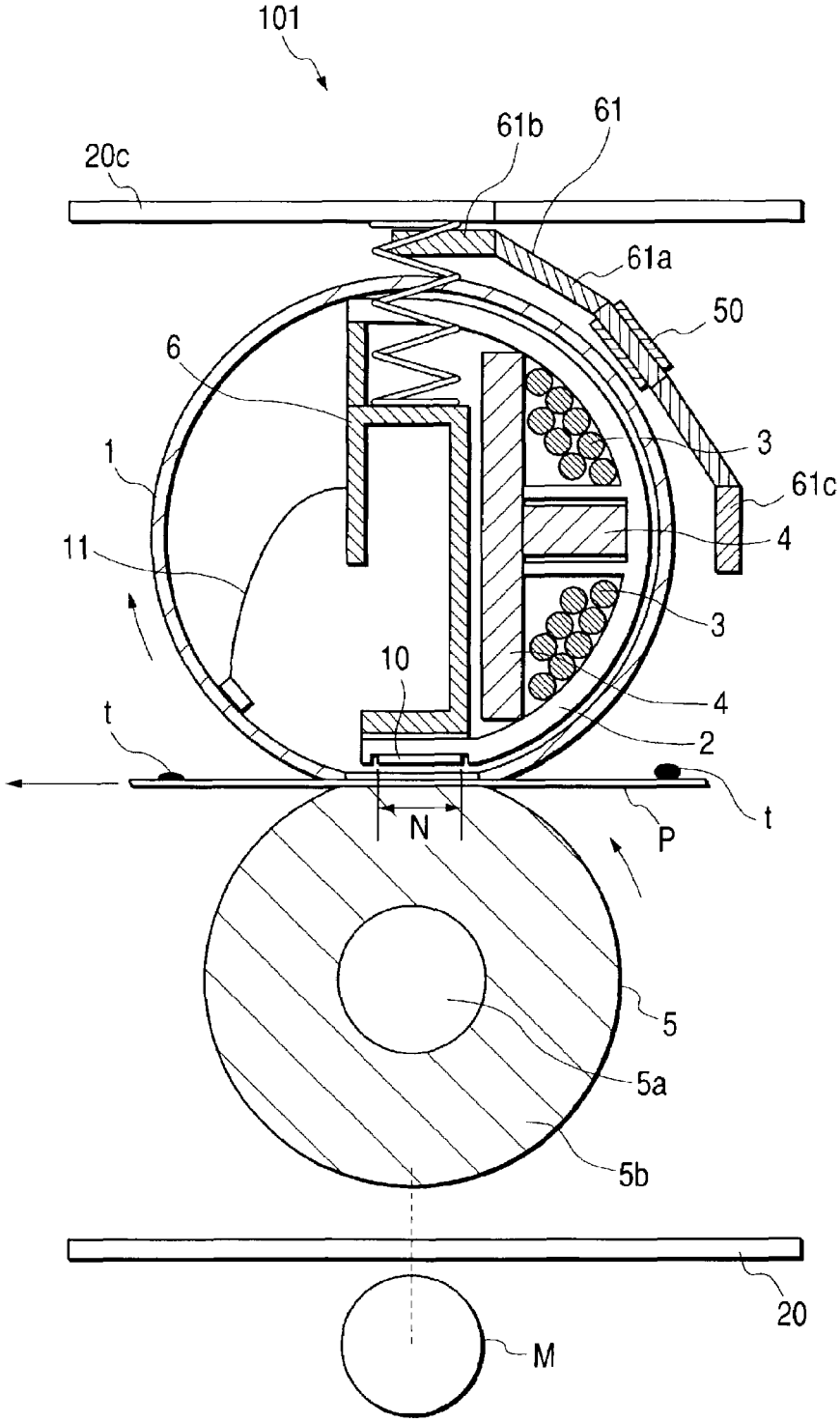
FIG. 8 is a sectional view of a heating device of a second embodiment.
Figure 9:
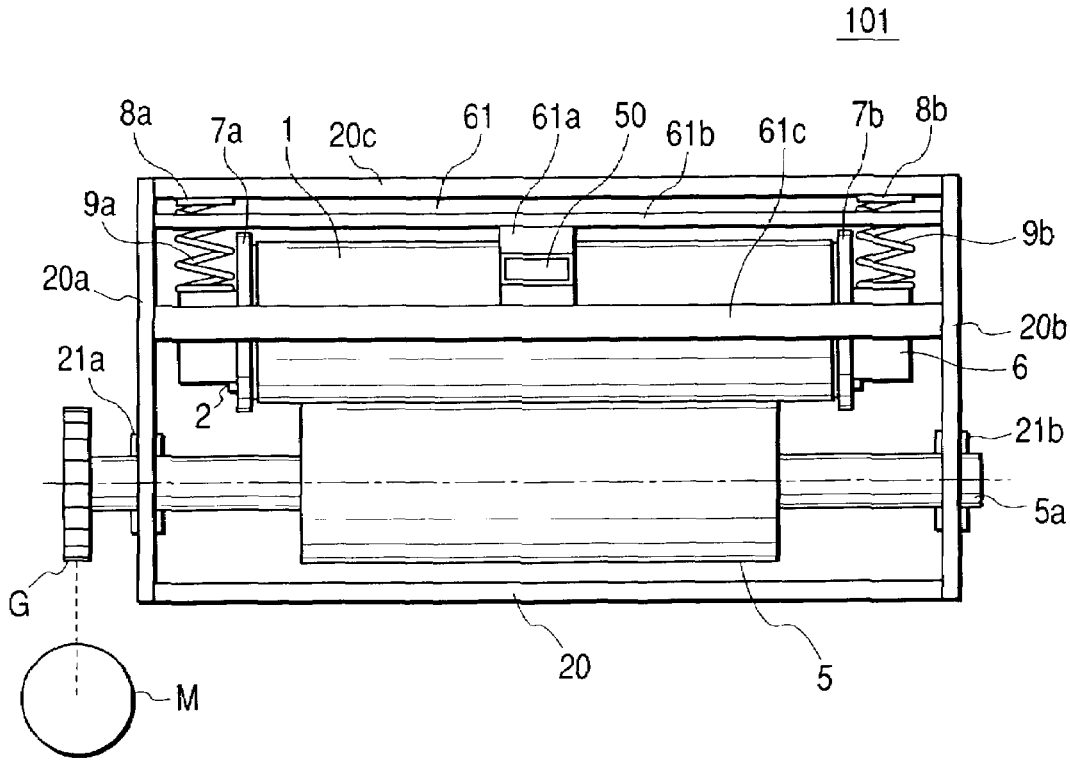
FIG. 9 is a schematic front view of the heating device of the second embodiment.

FIG. 8 is a schematic vertical sectional view of a body of a fixing device 101 of a second embodiment of the present invention, and FIG. 9 is a schematic front view of the body.

The fixing device of the present embodiment has a constitution, wherein, instead of the support member 60 which supports the temperature detecting member 50 as the safety device in the fixing device 100 of the first embodiment, a support member 61 is used.

That is, the support member 61 of the present embodiment is constituted of an insulating holder portion 61*a* and plate member portions 61*b* and 61*c*. The holder portion 61*a* is preferably made of a material having good electrically insulating properties and heat resistance such as phenol resin, polyimide resin, polyamide resin, polyamideimide resin, PEEK resin, PES resin, PPS resin, PFA resin, PTFE resin, FEP resin, LCP resin, or the like, and is provided in a portion facing the heat generation area H, and fixes and supports a temperature detecting member 50. Further, the plate member portions 61*b* and 61*c* are plate members made of a material which can provide accuracy of position with relative ease, such as a metallic material and the like; are fixed at the end portions thereof to chassis side plates 20*a* and 20*b* ; are provided above and beside the film 1 outside the heat generation area H in the longitudinal direction of the fixing device; and support the holder portion 61*a* at a longitudinal center portion thereof.

Also in the present embodiment, as for the support member 61, as described above, since the holder portion 61*a* is provided in the heat generation area H, and the plate member portions 61*b* and 61*c* are provided outside the heat generation area H, self-heat generation of the support member due to the leaked magnetic flux can be prevented, and thermal expansion of the support member can be suppressed. As a result, fluctuation of the distance between the temperature detecting member 50 and the outer peripheral surface of the film 1 due to deflection or the like of the support member and frame member due to thermal expansion can be made small.

Further, in contrast to the constitution where the temperature detecting member 50 is arranged above the film by one side support such as the holder portion 60*a* of the first embodiment, the present embodiment adopts a both side support constitution in which the temperature detecting member 50 is supported at the two points by the plate member portions 61*b* and 61*c*, so that it is easy to provide the accuracy of positional relationship between the temperature detecting member 50 and the outer peripheral surface of the film 1.

Accordingly, it is possible to prevent generation of contact traces and operation of the thermoswitch resulting a temperature rise, which is not an abnormal temperature rise, such as overshooting during temperature adjustment, followed by forced stop of heat generation of the film.

In the above-described embodiment, although the holder portion 61*a* is held by using two plate member portions 61*b* and 61*c*, the upper end of the holder portion 61*a* may be directly fixed to the chassis 20*c* instead of the plate member portion 61*b*.

Third Embodiment

Figure 10:
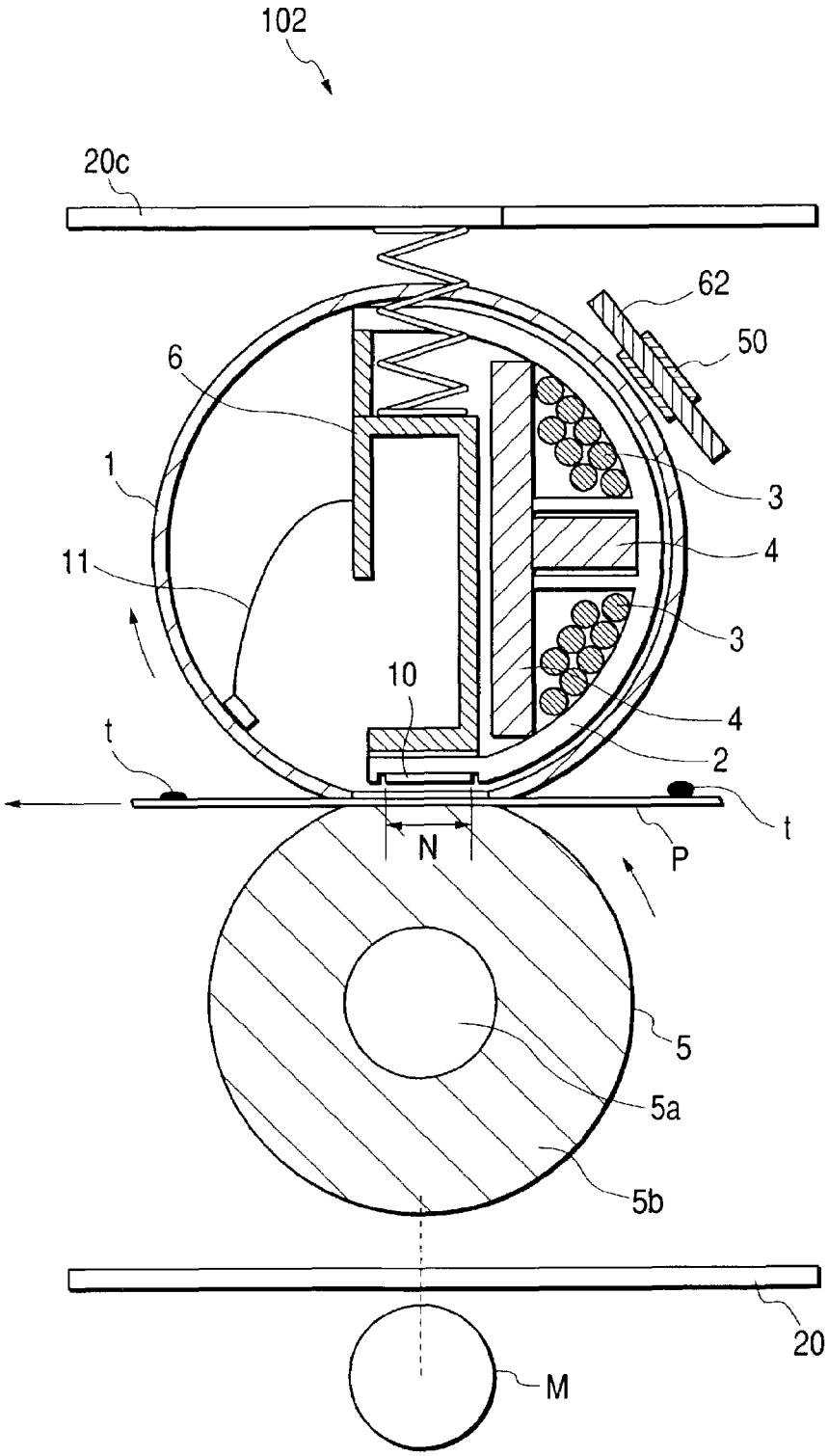
FIG. 10 is a sectional view of a heating device of a third embodiment.
Figure 11:
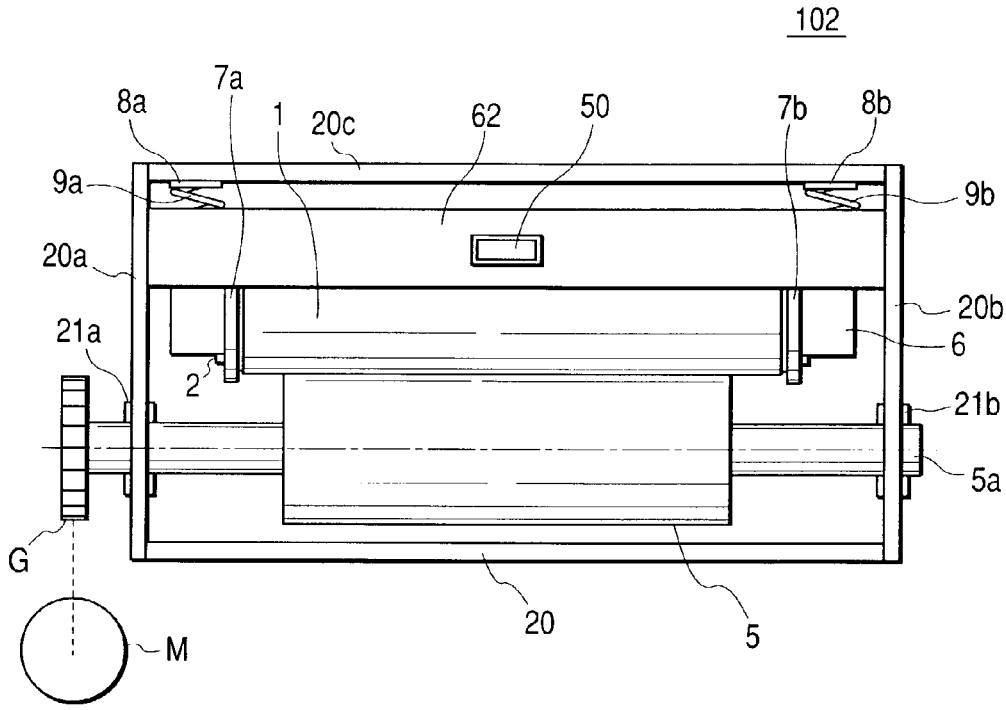
FIG. 11 is a schematic front view of the heating device of the third embodiment.

FIG. 10 is a schematic vertical sectional view of a body of a fixing device 102 of a third embodiment of the present invention and FIG. 11 is a schematic front view of the body.

The fixing device of the present invention has a constitution in which instead of the support member 60 which supports the temperature detecting member 50 as the safety device in the fixing device 100 of the first embodiment, a support member 62 is used.

That is, the support member 62 of the present embodiment is a member such that the insulating holder portion is extended in the longitudinal direction of the fixing device; is fixed at the longitudinal end portions thereof to chassis side plates 20*a* and 20*b* ; and is provided in the heat generation area H. In the longitudinal center portion of the support member 62 is fixedly supported a temperature detecting member 50, and the distance between the outer peripheral surface of the film 1 and the temperature detecting member 50 is set to be 2 mm.

In the present embodiment, as described above, since an insulating member is used as the support member 62, even when it is arranged in a portion facing the heat generation area H, self-heat generation of the support member itself due to leaked magnetic flux can be prevented and thermal expansion of the support member can be suppressed. As a result, fluctuation of the distance between the temperature detecting member 50 and the outer peripheral surface of the film 1 by deflection or the like of the support member and frame member due to thermal expansion can be made small.

Further, since in the present embodiment, the support member is not required to be constituted of the holder portion and the plate member portion unlike the first and the second embodiments and can be formed integrally by molding a single resin member, it is possible to reduce the production cost.

Having described preferred embodiments of the invention, it is to be understood that the present invention is not limited to those embodiments, but is susceptible to various changes and modifications without departing from the spirit and scope of the invention.

What is claimed is:

1. An image heating device for heating an image formed on a recording material, comprising:

a rotatable heating member having a heat generation layer;

an excitation coil provided on an inner surface side of said rotatable heating member to generate a magnetic field to induce an eddy current in the heat generation layer, wherein said heat generation layer generates heat by the eddy current induced in the heat generation layer;

a thermistor for detecting a temperature of said rotatable heating member, wherein an electrical power supply to said excitation coil is controlled based on a detected temperature detected by said thermistor to maintain a temperature of said rotatable member at a predetermined temperature;

safety means including a temperature detecting member for detecting a temperature of said rotatable heating member, wherein said safety means shuts off an electrical power supply to said excitation coil when the temperature of said rotatable heating member rises excessively; and a holder having a holding portion to hold the temperature detecting member, wherein, in said holder, at least the holding portion is insulated, wherein said temperature detecting member is positioned at an outer surface side of said heating member and at a position opposing a heat generation area of said rotatable heating member in a rotational direction of said rotatable heating member, and wherein said temperature detecting member and the holding portion of said holder are arranged in the magnetic field generated by said execution coil.

2. The image heating device according to claim 1, wherein said holder is made of a resin.

3. The image heating device according to claim 1, further comprising a second holder for holding said holder, wherein said second holder is fixed to a frame of said device.

4. The image heating device according to claim 3, wherein said second holder is electrically conductive.

5. The image heating device according to claim 1, wherein said holder is fixed to a frame of said device.

6. The image heating device according to claim 1, wherein said rotatable heating member has flexibility.

7. The image heating device according to claim 1, further comprising a pressure roller which is in contact with said rotating member to form a nip portion, for sandwiching and conveying the recording material.

* * * * *

UNITED STATES PATENT AND TRADEMARK OFFICE

CERTIFICATE OF CORRECTION

PATENT NO. : 7,021,753 B2
APPLICATION NO. : 10/243666
DATED : April 4, 2006
INVENTOR(S) : Tetsuya Sano et al.

It is certified that error appears in the above-identified patent and that said Letters Patent is hereby corrected as shown below:

COLUMN 4:
Line 40, "the by" should read --by the--.

COLUMN 5:
Line 51, "taken)of" should read --taken) of--.
Line 53, "an" should read --a--.

Signed and Sealed this

Seventeenth Day of October, 2006

JON W. DUDAS
*Director of the United States Patent and Trademark Office*